US012123671B2

(12) United States Patent
Kumar et al.

(10) Patent No.: US 12,123,671 B2
(45) Date of Patent: Oct. 22, 2024

(54) MUZZLE END ADAPTER TO PERFORM BORE SIGHT OF A SMALL CALIBER GUN

(71) Applicant: Tonbo Imaging Pte. Ltd., Singapore (SG)

(72) Inventors: Ankit Kumar, Bangalore (IN); Kondangi Lakshmikumar Arvind, Singapore (SG); Nelaji Mohanrao Sudarshan, Bangalore (IN)

(73) Assignee: Tonbo Imaging Pte. Ltd., Singapore (SG)

( * ) Notice: Subject to any disclaimer, the term of this patent is extended or adjusted under 35 U.S.C. 154(b) by 72 days.

(21) Appl. No.: 18/051,340

(22) Filed: Oct. 31, 2022

(65) Prior Publication Data

US 2024/0142190 A1 May 2, 2024

(51) Int. Cl.
*F41G 1/54* (2006.01)
*F41A 21/32* (2006.01)

(52) U.S. Cl.
CPC ..... *F41A 21/325* (2013.01); *F41G 1/545* (2013.01)

(58) Field of Classification Search
CPC ..... F41G 1/545; F41G 1/54
See application file for complete search history.

(56) References Cited

U.S. PATENT DOCUMENTS 5,432,598 A * 7/1995 Szatkowski ..... F41G 1/545 356/153
5,486,913 A * 1/1996 Aharon ..... F41G 1/545 356/153
6,295,753 B1 * 10/2001 Thummel ..... F41A 33/02 42/116
8,695,266 B2 * 4/2014 Moore ..... F41G 1/44 356/249
10,739,109 B1 * 8/2020 Tello ..... F41G 3/08
2016/0245620 A1 * 8/2016 Tello ..... F41G 3/2644
2019/0093987 A1 * 3/2019 Tello ..... F41G 3/323
2021/0247165 A1 * 8/2021 Tello ..... F41G 3/323

FOREIGN PATENT DOCUMENTS

WO WO-2022150858 A2 * 7/2022 ..... F41G 1/545

* cited by examiner

*Primary Examiner* — Jonathan C Weber
(74) *Attorney, Agent, or Firm* — Kolisch Hartwell, P.C.

(57) ABSTRACT

The present disclosure provides a muzzle end adapter for performing bore sighting of a small caliber gun. The muzzle end adapter includes a plurality of hand levers. In addition, the muzzle end adapter includes a main operating shaft connected rigidly with a first hand lever. Also, the muzzle end adapter includes a cylindrical member connected at one end of the main operating shaft. Moreover, the muzzle end adapter includes a plurality of centering devices. The plurality of centering devices includes a plurality of jaws. The plurality of jaws includes a plurality of equiangular spaced jaws centered around a pivot pin. Further, the muzzle end adapter includes a disk. Furthermore, the disk includes a tapered hole connected with the muzzle end adapter.

20 Claims, 7 Drawing Sheets

100

400

MUZZLE END ADAPTER TO PERFORM BORE SIGHT OF A SMALL CALIBER GUN

TECHNICAL FIELD

The present disclosure relates to the field of bore sighting, and in particular, relates to an adapter to perform bore sight of small caliber gun.

BACKGROUND

Bore sighting refers to a method of adjustment to an optical firearm sight to align firearm barrel and sights. The axis of barrel of a firearm must be either parallel or must cross the axis of optical sighting system of the firearm. Therefore, a pre-determined relationship must be established between axis of the barrel and the axis of the optical sighting system of the firearm. However, the axis of the optical sighting system of firearms usually gets displaced from the axis of the barrel of the firearm. This displacement occurs due to a number of reasons such as changes resulting from material strains, thermal expansion of firearms during firing, varying environmental temperature and so on. Therefore, recalibration must be done from time to time. The relationship between the axis of the barrel of the firearm and the axis of the optical sighting system of the firearm is established. Accordingly, a sight is made to a calibration target at a given distance. Further, the line of sight is established along the axis of the barrel of the firearm for accurate and effective bore sighting. Furthermore, the axis of the optical sighting system is calibrated in accordance with the axis of the barrel of the firearm.

SUMMARY

In a first aspect, the present disclosure provides a muzzle end adapter. The muzzle end adapter performs bore sighting of a small caliber gun. The muzzle end adapter includes a plurality of hand levers. In addition, the muzzle end adapter includes a main operating shaft connected rigidly with a first hand lever. Further, the muzzle end adapter includes a cylindrical member connected at one end of the main operating shaft. Also, the muzzle end adapter includes a plurality of centering devices. Further, the muzzle end adapter includes a disk. The plurality of hand levers are positioned at a first end of the muzzle end adapter. The plurality of hand levers includes the first hand lever and a second hand lever. The first hand lever is rotated in a first direction by a user. The main operating shaft extends along a longitudinal axis of the muzzle end adapter. The main operating shaft rotates in the first direction upon rotation of the first hand lever by the user. The cylindrical member extends along the longitudinal axis of the muzzle end adapter. The cylindrical member slides axially upon rotation of the main operating shaft. The plurality of centering devices includes a plurality of jaws. The plurality of jaws includes a plurality of equiangular spaced jaws centered around a pivot pin. The plurality of jaws extends radially to engage with inner periphery of the small caliber gun upon axial sliding of the cylindrical member. The disk includes a tapered hole connected with the muzzle end adapter. The tapered hole enables attachment of a camera to perform bore sight of the small caliber gun.

In an embodiment of the present disclosure, the muzzle end adapter is inserted inside a bore of the small caliber gun. The muzzle end adapter is inserted manually by the user.

In an embodiment of the present disclosure, the first hand lever is rigidly connected with the main operating shaft. The second hand lever is rigidly connected with the muzzle end adapter.

In an embodiment of the present disclosure, the plurality of centering devices includes a plurality of jaws carrier. The plurality of jaws carrier includes a first jaws carrier and a second jaws carrier. The first jaws carrier and the second jaws carrier are separated by a cylindrical spacer.

In an embodiment of the present disclosure, the plurality of jaws includes a first plurality of jaws and a second plurality of jaws. The first plurality of jaws are situated on a first jaws carrier. The second plurality of jaws are situated on a second jaws carrier. The plurality of jaws includes one or more outer edges. The one or more outer edges are concentric to the longitudinal axis of the main operating shaft. Each of the one or more outer edges are of equal radius.

In an embodiment of the present disclosure, the muzzle end adapter includes a plurality of slots on outer periphery of the muzzle end adapter. The plurality of slots are of suitable shape and size to provide an inclined surface. The inclined surface receives the plurality of jaws upon rotation of the first hand lever by the user.

In an embodiment of the present disclosure, the camera is attached in the tapered hole using an orienting pin.

In an embodiment of the present disclosure, the muzzle end adapter includes a second threading onto the first end of the muzzle end adapter. The main operating shaft includes an equivalent first threading to be inserted into the second threading of the muzzle end adapter.

In an embodiment of the present disclosure, the first hand lever is rotated in a second direction by the user for removing the muzzle end adapter from the small caliber gun.

In an embodiment of the present disclosure, the muzzle end adapter includes a return spring. The return spring is compressed upon rotation of the first hand lever in the first direction by the user. The return spring is expanded upon rotation of the first hand lever in the second direction by the user.

In a second aspect, the present disclosure provides a muzzle end adapter. The muzzle end adapter performs bore sighting of a small caliber gun. The muzzle end adapter includes a plurality of hand levers. In addition, the muzzle end adapter includes a main operating shaft connected rigidly with a first hand lever. Further, the muzzle end adapter includes a cylindrical member connected at one end of the main operating shaft. Also, the muzzle end adapter includes a plurality of centering devices. Further, the muzzle end adapter includes a disk. The plurality of hand levers are positioned at a first end of the muzzle end adapter. The plurality of hand levers includes the first hand lever and a second hand lever. The first hand lever is rotated in a first direction by a user. The main operating shaft extends along a longitudinal axis of the muzzle end adapter. The main operating shaft rotates in the first direction upon rotation of the first hand lever by the user. The cylindrical member extends along the longitudinal axis of the muzzle end adapter. The cylindrical member slides axially upon rotation of the main operating shaft. The plurality of centering devices includes a plurality of jaws carrier. The plurality of jaws carrier includes a first jaws carrier and a second jaws carrier. The plurality of centering devices includes a plurality of jaws. The plurality of jaws includes a plurality of equiangular spaced jaws centered around a pivot pin. The plurality of jaws extends radially to engage with inner periphery of the small caliber gun upon axial sliding of the cylindrical member. The plurality of jaws includes a first plurality of jaws and a second plurality of jaws. The first plurality of jaws are situated on a first jaws carrier. The second plurality of jaws are situated on a second jaws carrier. The disk includes a tapered hole connected with the muzzle end adapter. The tapered hole enables attachment of a camera to perform bore sight of the small caliber gun.

In an embodiment of the present disclosure, the muzzle end adapter is inserted inside a bore of the small caliber gun. The muzzle end adapter is inserted manually by the user.

In an embodiment of the present disclosure, the first hand lever is rigidly connected with the main operating shaft. The second hand lever is rigidly connected with the muzzle end adapter.

In an embodiment of the present disclosure, the first jaws carrier and the second jaws carrier are separated by a cylindrical spacer.

In an embodiment of the present disclosure, the plurality of jaws includes one or more outer edges. The one or more outer edges are concentric to the longitudinal axis of the main operating shaft. Each of the one or more outer edges are of equal radius.

In an embodiment of the present disclosure, the muzzle end adapter includes a plurality of slots on outer periphery of the muzzle end adapter. The plurality of slots are of suitable shape and size to provide an inclined surface. The inclined surface receives the plurality of jaws upon rotation of the first hand lever by the user.

In an embodiment of the present disclosure, the camera is attached in the tapered hole using an orienting pin.

In an embodiment of the present disclosure, the muzzle end adapter includes a second threading onto the first end of the muzzle end adapter. The main operating shaft includes an equivalent first threading to be inserted into the second threading of the muzzle end adapter.

In an embodiment of the present disclosure, the first hand lever is rotated in a second direction by the user for removing the muzzle end adapter from the small caliber gun.

In an embodiment of the present disclosure, the muzzle end adapter includes a return spring. The return spring is compressed upon rotation of the first hand lever in the first direction by the user. The return spring is expanded upon rotation of the first hand lever in the second direction by the user.

BRIEF DESCRIPTION OF THE FIGURES

Figure 1A:
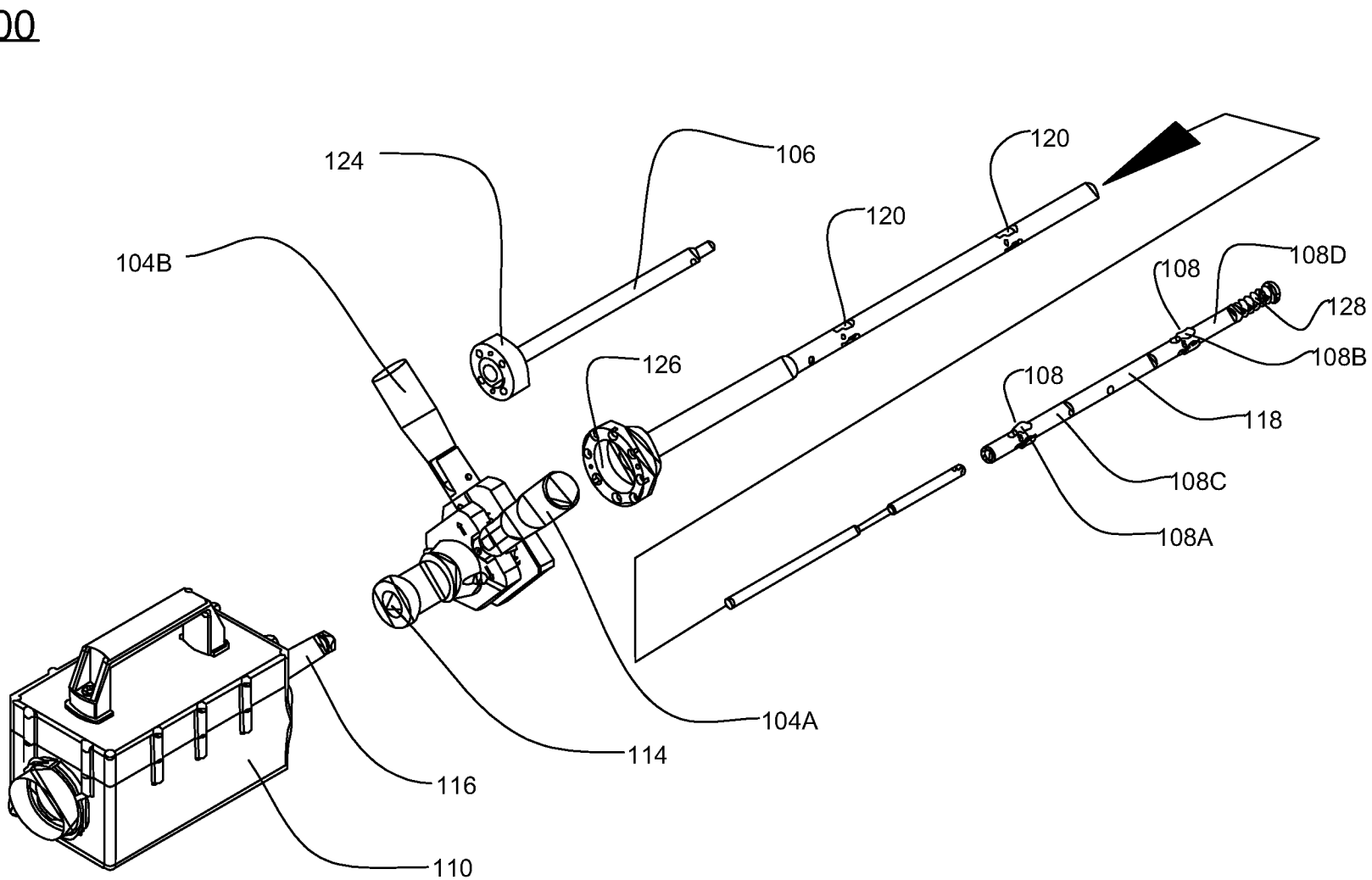
Figure 1B:
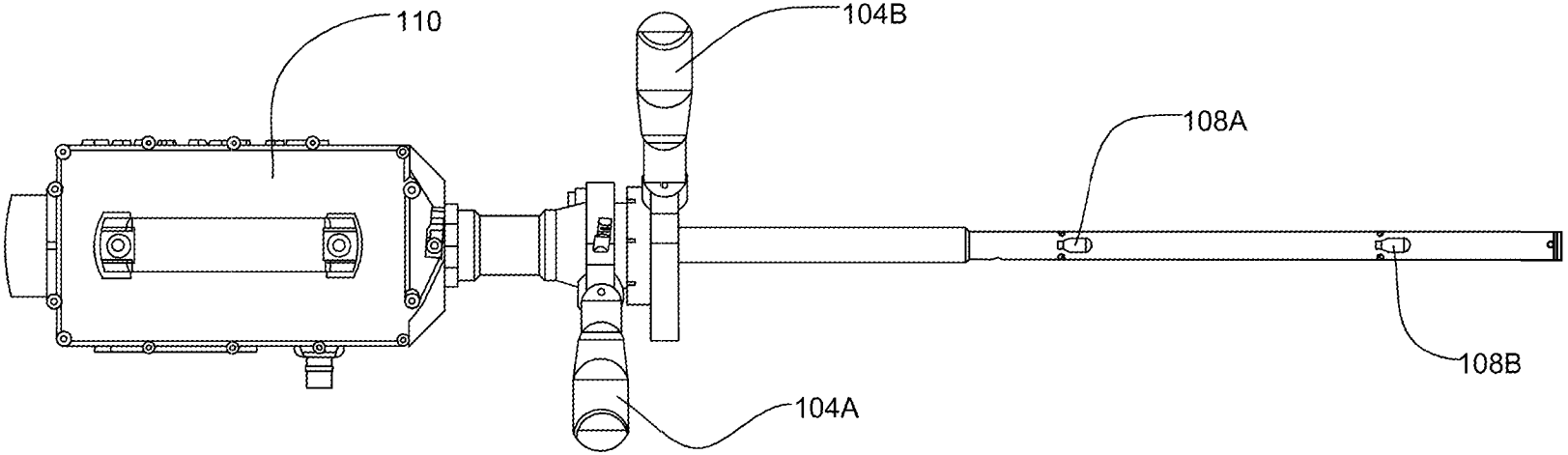
Figure 1C:
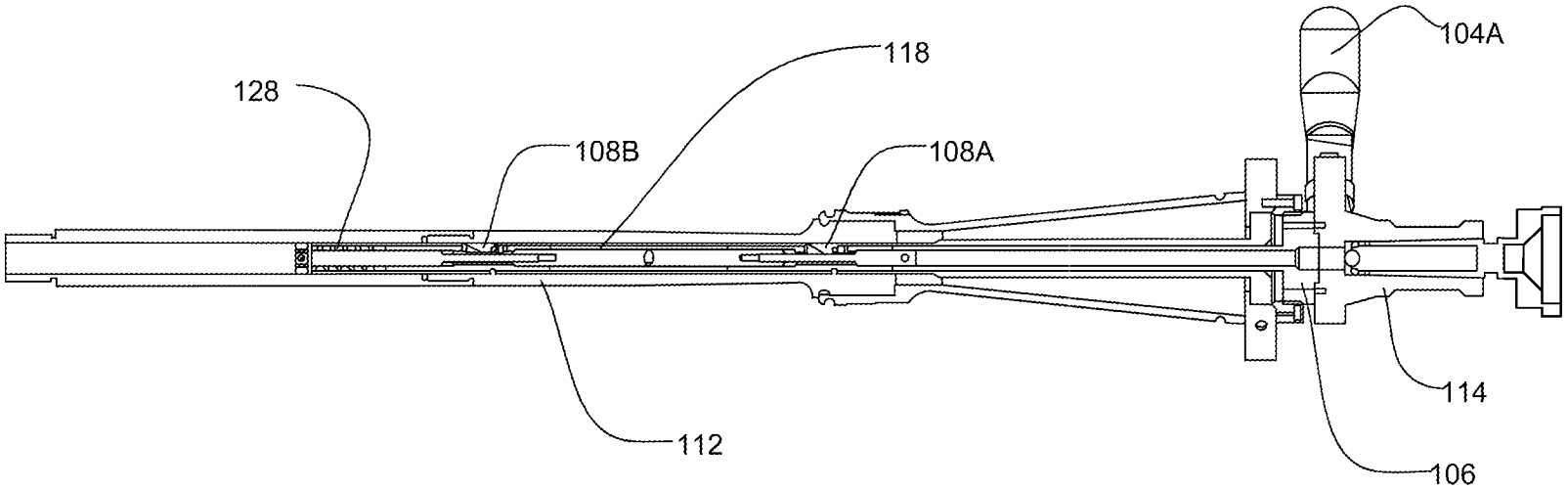
Figure 1D:
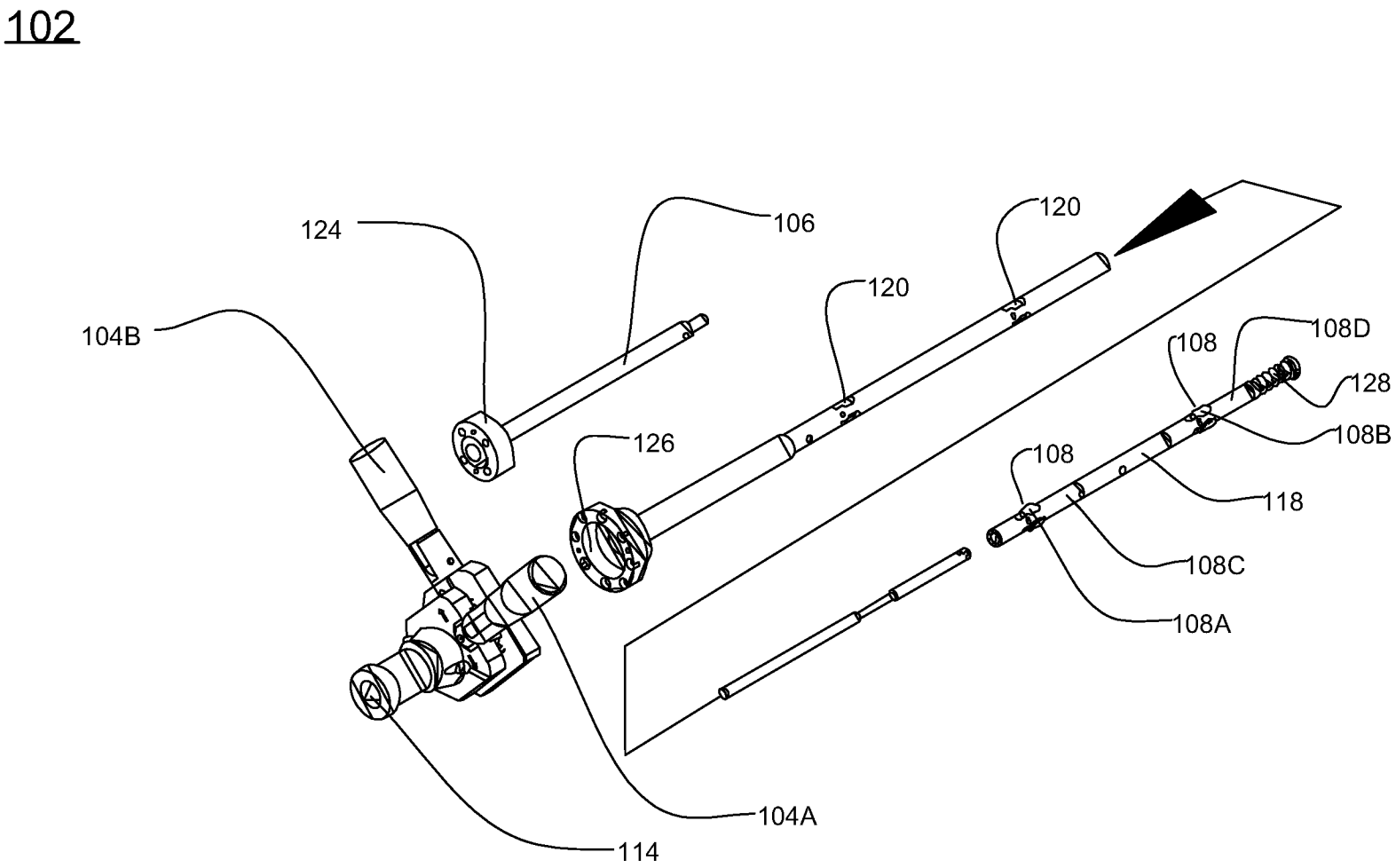
Figure 2:
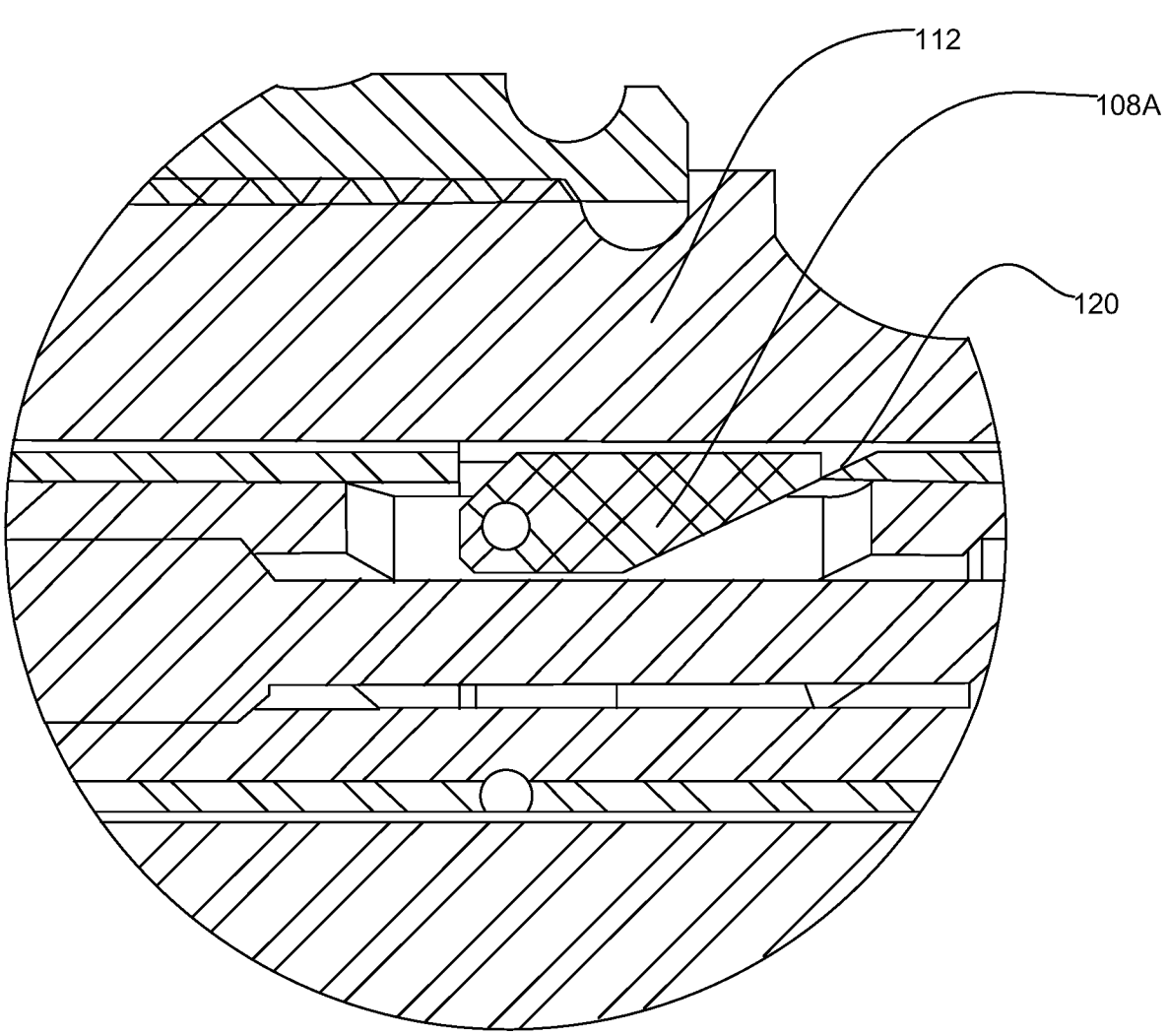
Figure 3:
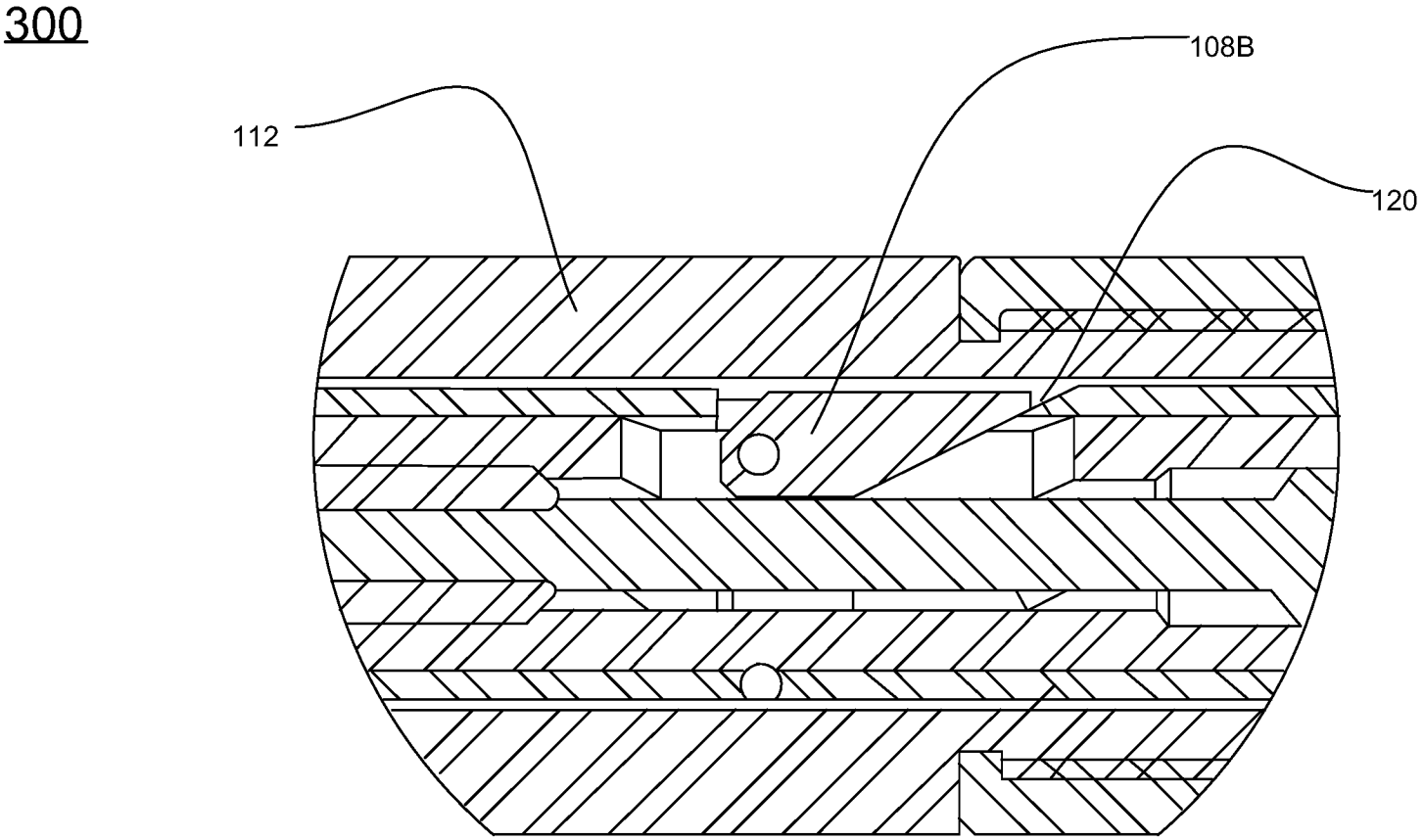
Figure 4:
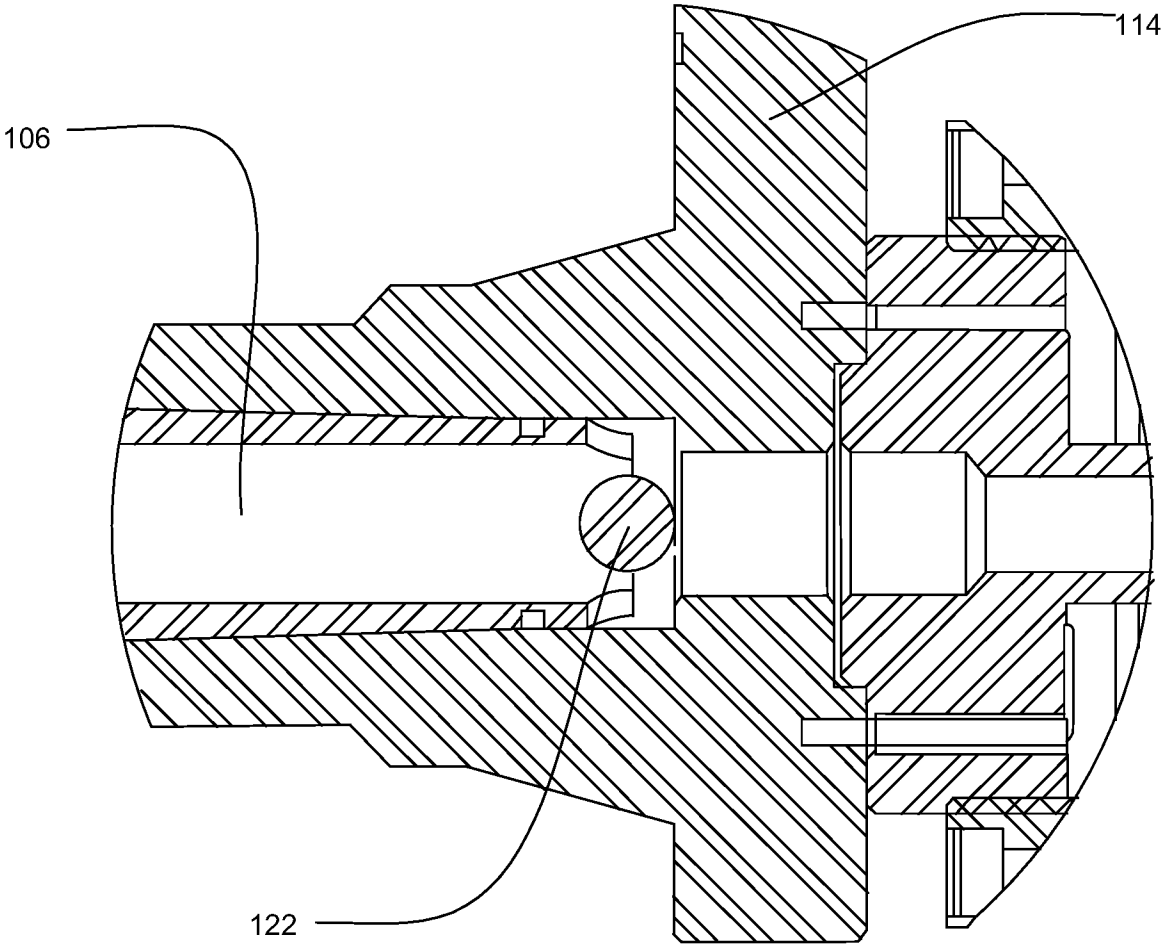

Having thus described the invention in general terms, reference will now be made to the accompanying drawings, which are not necessarily drawn to scale, and wherein:

FIG. 1A illustrates an exploded perspective view of a muzzle end adapter along with a camera, in accordance with various embodiments of the present disclosure;

FIG. 1B illustrates a top view of the muzzle end adapter along with the camera, in accordance with various embodiments of the present disclosure;

FIG. 1C illustrates a perspective view of the muzzle end adapter inside a bore of a small caliber gun, in accordance with various embodiments of the present disclosure;

FIG. 1D illustrates an exploded perspective view of the muzzle end adapter, in accordance with various embodiments of the present disclosure;

FIG. 2 illustrates a detailed section view of a first plurality of jaws of the muzzle end adapter, in accordance with an embodiment of the present disclosure;

FIG. 3 illustrates a detailed section view of a second plurality of jaws of the muzzle end adapter, in accordance with an embodiment of the present disclosure; and FIG. 4 illustrates a detailed section view of an orienting pin of the muzzle end adapter, in accordance with an embodiment of the present disclosure.

DETAILED DESCRIPTION

In the following description, for purposes of explanation, numerous specific details are set forth in order to provide a thorough understanding of the present technology. It will be apparent, however, to one skilled in the art that the present technology can be practiced without these specific details. In other instances, structures and devices are shown in block diagram form only in order to avoid obscuring the present technology.

Reference in this specification to "one embodiment" or "an embodiment" means that a particular feature, structure, or characteristic described in connection with the embodiment is included in at least one embodiment of the present technology. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Moreover, although the following description contains many specifics for the purposes of illustration, anyone skilled in the art will appreciate that many variations and/or alterations to said details are within the scope of the present technology. Similarly, although many of the features of the present technology are described in terms of each other, or in conjunction with each other, one skilled in the art will appreciate that many of these features can be provided independently of other features. Accordingly, this description of the present technology is set forth without any loss of generality to, and without imposing limitations upon, the present technology.

FIG. 1A illustrates an exploded perspective view 100 of a muzzle end adapter 102 along with a camera 110, in accordance with various embodiments of the present disclosure. FIG. 1B illustrates a top view 100 of the muzzle end adapter 102 along with the camera 110, in accordance with various embodiments of the present disclosure. FIG. 1C illustrates a perspective view 100 of the muzzle end adapter 102 inside a bore 112 of a small caliber gun, in accordance with various embodiments of the present disclosure. FIG. 1D illustrates an exploded perspective view of the muzzle end adapter 102, in accordance with various embodiments of the present disclosure. FIG. 2 illustrates a detailed section view of a first plurality of jaws 108*a* of the muzzle end adapter 102, in accordance with an embodiment of the present disclosure. FIG. 3 illustrates a detailed section view of a second plurality of jaws 108*b* of the muzzle end adapter 102, in accordance with various embodiments of the present disclosure. FIG. 4 illustrates a detailed section view of an orienting pin 122 of the muzzle end adapter 102, in accordance with an embodiment of the present disclosure.

The muzzle end adapter 102 includes a plurality of hand levers 104*a-b*, a main operating shaft 106, a plurality of jaws 108 and a disk 114. In addition, the muzzle end adapter 102 includes a cylindrical spacer 118, a plurality of slots 120, the orienting pin 122, a first threading 124, a second threading 126, and a return spring 128. Further, the plurality of hand levers 104*a-b* includes a first hand lever 104*a* and a second hand lever 104*b*. Furthermore, the plurality of jaws 108 includes the first plurality of jaws 108*a* and the second plurality of jaws 108*b*. Moreover, muzzle end adapter 102 includes a plurality of centering devices. The plurality of centering devices includes the plurality of jaws 108, a pivot pin, and a plurality of jaws carrier. The plurality of jaws carrier includes a first jaws carrier 108*c* and a second jaws carrier 108*d*.

The muzzle end adapter 102 has a cylindrical outer periphery that enables the muzzle end adapter 102 to insert inside the bore 112 of the small caliber gun. In general, bore is interior of barrel of any gun or firearm. In an embodiment of the present disclosure, the muzzle end adapter 102 is of suitable length such that the muzzle end adapter 102 passes through length of the bore 112 of the small caliber gun. In an embodiment of the present disclosure, the muzzle end adapter 102 is made up of a suitable material. In an example, the suitable material may include plastic, metal, stainless steel, rubber and the like.

The muzzle end adapter 102 includes the plurality of hand levers 104*a-b*. The plurality of hand levers 104*a-b* are positioned at a first end of the muzzle end adapter 102. In general, hand levers are large switches designed to activate or deactivate any system by hand. In addition, hand levers are used in a variety of motor vehicles and other large machinery. The plurality of hand levers 104*a-b* includes the first hand lever 104*a* and the second hand lever 104*b*. The first hand lever 104*a* is rigidly connected with the main operating shaft 106. The second hand lever 104*b* is rigidly connected with the muzzle end adapter 102. The plurality of hand levers 104 are held by a user for inserting the muzzle end adapter 102 inside the bore 112 of the small caliber gun. The user utilizes the second hand lever 104*b* to hold the muzzle end adapter 102 firmly. The first hand lever 104*a* is rotated in a first direction by the user. In an embodiment of the present disclosure, the first direction represents right direction. In another embodiment of the present disclosure, the first direction represents any other direction. In an embodiment of the present disclosure, the user applies torque in the first direction using the first hand lever 104*a*.

In an embodiment of the present disclosure, the user is any person who performs bore sight of the small caliber gun. In another embodiment of the present disclosure, the user is any person who handles operation of the muzzle end adapter 102. In yet another embodiment of the present disclosure, the user is any person who performs maintenance of the muzzle end adapter 102. In yet another embodiment of the present disclosure, the user is any person that has knowledge to operate the muzzle end adapter 102 to perform bore sight of the small caliber gun.

The muzzle end adapter 102 includes the main operating shaft 106. The main operating shaft 106 is connected rigidly with the first hand lever 104*a*. The main operating shaft 106 extends through a longitudinal axis of the muzzle end adapter 102. In general, longitudinal axis is an imaginary axis passing through lengthwise direction of any figure or body. The main operating shaft 106 rotates in the first direction upon rotation of the first hand lever 104*a* by the user. In an embodiment of the present disclosure, the main operating shaft 106 is threaded to a collar connected with the muzzle end adapter 102.

The muzzle end adapter 102 includes the first threading 124 and the second threading 126. In an embodiment of the present disclosure, the first threading 124 is a male threading. In an embodiment of the present disclosure, the second threading 126 is a female threading. In general, female thread is a receptacle used to receive and hold male thread. The muzzle end adapter 102 includes the second threading 126 onto the first end of the muzzle end adapter 102. The main operating shaft 106 includes the equivalent first threading 124 to be inserted into the second threading 126 of the muzzle end adapter 102.

The muzzle end adapter 102 includes a cylindrical member. The cylindrical member is connected at a first end of the main operating shaft 106. Also, the cylindrical member extends along the longitudinal axis of the muzzle end adapter 102. In addition, the main operating shaft 106 rotates in the first direction upon rotation of the first hand lever 104*a* by the user. In an embodiment of the present disclosure, the cylindrical member is co-axial with the muzzle end adapter 102. The threaded connection of the main operating shaft 106 with the muzzle end adapter 102 enables movement of the cylindrical member inside the bore 112 of the small caliber gun upon rotation of the main operating shaft 106 in the first direction. In an embodiment of the present disclosure, the cylindrical member completely touches the plurality of jaws 108.

The muzzle end adapter 102 includes the plurality of centering devices. The plurality of centering devices includes the plurality of jaws 108. The plurality of jaws 108 includes a plurality of equiangular spaced jaws centered around the pivot pin. The plurality of jaws 108 extends radially to engage with inner periphery of the bore 112 of the small caliber gun upon axial sliding of the cylindrical member.

In an embodiment of the present disclosure, the main operating shaft 106 is affixed with the plurality of jaws 108. The plurality of jaws 108 includes the first plurality of jaws 108*a* and the second plurality of jaws 108*b*. The plurality of centering devices includes the plurality of jaws carrier. The plurality of jaws carrier includes the first jaws carrier 108*c* and the second jaws carrier 108*d*. The first plurality of jaws 108*a* are situated on the first jaws carrier 108*c*. The second plurality of jaws 108*b* are situated on the second jaws carrier 108*d*. The first plurality of jaws 108*a* are situated near muzzle brake of the small caliber gun. The second plurality of jaws 108*b* are placed at opposite end of the muzzle brake adapter. In general, muzzle brake is a device connected to muzzle of a firearm or cannon that redirects propellant gases to counter recoil and unwanted muzzle rise.

In an embodiment of the present disclosure, the first jaws carrier 108*c* is front jaws carrier. In an embodiment of the present disclosure, the second jaws carrier 108*d* is back jaws carrier. Further, the first jaws carrier 108*c* and the second jaws carrier 108*d* are separated by a cylindrical spacer 118. In an embodiment of the present disclosure, the cylindrical spacer 118 ensures that same amount of axial motion is transferred to the first jaws carrier 108*c* and the second jaws carrier 108*d*. In an embodiment of the present disclosure, the pivot pin is pivoted around central axis of each of the plurality of jaws carrier.

In an embodiment of the present disclosure, the plurality of jaws 108 expand radially in uniform manner upon axial sliding of the plurality of jaws carrier. In addition, the plurality of jaws 108 expand towards the inner periphery of the bore 112 of the small caliber gun. Also, each of the plurality of jaws 108 uniformly comes in contact with the inner periphery of the bore 112 of the small caliber gun. In an embodiment of the present disclosure, the plurality of jaws 108 attaches rigidly inside the bore 112 of the small caliber gun in co-axial manner.

In an embodiment of the present disclosure, the axial motion of the main operating shaft 106 transfers to the plurality of the first jaws carrier 108*c* upon rotation of the first hand lever 104*a* in the first direction. In an embodiment of the present disclosure, the muzzle end adapter 102 includes one or more grooves inside inner periphery of the muzzle end adapter 102. The one or more grooves restrict rotation of the plurality of jaws 108 upon rotation of the first hand lever 104*a* in the first direction by the user.

The first plurality of jaws 108*a* are located near muzzle brake of the small caliber gun. The plurality of jaws 108 includes one or more outer edges. The one or more outer edges are concentric to a longitudinal axis of the main operating shaft 106. In addition, each of the one or more outer edges are of equal radius. In addition, the plurality of jaws 108 include one or more inner edges. The one or more inner edges are defined on an inclined. The one or more inner edges of the plurality of jaws 108 mate with inclined surface of the plurality of slots 120 on the muzzle end adapter 102.

The muzzle end adapter 102 includes the plurality of slots 120 on outer periphery of the muzzle end adapter 102. The plurality of slots 120 are of suitable shape and size to provide an inclined surface. The inclined surface of the plurality of slots 120 receives the plurality of jaws 108 upon rotation of the first hand lever 104*a* by the user. The plurality of slots 120 are of suitable number to receive the plurality of jaws 108 upon rotation of the first hand lever 104*a* by the user.

The muzzle end adapter 102 includes the disk 114. The disk 114 includes a tapered hole connected with the muzzle end adapter 102. The tapered hole enables attachment of the camera 110 to perform bore sight of the small caliber gun. In an embodiment of the present disclosure, the camera 110 is a bore sight telescope camera. In an embodiment of the present disclosure, the camera 110 has an appropriate Field of View (hereinafter, FOV). In general, FOV refers to open observable area up to which a person can see through his or her eyes or via an optical device. In case of optical devices and sensors, FOV describes angle through which devices can pick up electromagnetic radiations. The camera 110 is attached in a co-axial manner extending through the longitudinal axis of the muzzle end adapter 102 through the tapered hole. In an embodiment of the present disclosure, the user makes a sight through the camera 110 to perform bore sight of the small caliber gun.

In an embodiment of the present disclosure, the camera 110 includes a conical shaft 116. The conical shaft 116 of the camera 110 is attached with the tapered hole inside the disk 114 of the muzzle end adapter 102 manually by the user. In an embodiment of the present disclosure, the conical shaft 116 includes one or more notches. The one or more notches allows the camera 110 to insert into one or more positions. In an example, the one or more positions are positions that enables attachment of the camera 110 into two positions rotated by an angle of 90°. In addition, the camera 110 rotates in the one or more positions using the orienting pin 122.

In an embodiment of the present disclosure, the camera 110 is connected with a monitor. The monitor is operated by an operator. In an embodiment of the present disclosure, the user and the operator is a same person. In another embodiment of the present disclosure, the user and the operator are different persons. In an embodiment of the present disclosure, the monitor is used to perform bore sight of the small caliber gun. In another embodiment of the present disclosure, the monitor is used to identify errors such as concentricity errors, misalignment errors, and the like of the small caliber gun.

In an embodiment of the present disclosure, center of the bore 112 of the small caliber gun is located and aligned with a longitudinal axis of the camera 110 by the operator. Further, the bore 112 of the small caliber gun is moved to sight a target positioned at a known distance. In an embodiment of the present disclosure, an optical sighting system of the small caliber gun is adjusted to be parallel to longitudinal axis of the bore 112 of the small caliber gun. In another embodiment of the present disclosure, the optical sighting system of the small caliber gun is adjusted to intersect longitudinal axis of the bore 112 of the small caliber gun. The optical sighting system is adjusted to perform bore sight of the small caliber gun.

The camera 110 is removed from the muzzle end adapter 102 after the bore sight is performed. Further, the first hand lever 104*a* is rotated in a second direction by the user to remove the muzzle end adapter 102 from the small caliber gun. The muzzle end adapter 102 includes the return spring 128. The return spring 128 compresses upon rotation of the first hand lever 104*a* in the first direction by the user. The return spring 128 expands upon rotation of the first hand lever 104*a* in the second direction by the user. The expansion of the return spring 128 moves the plurality of jaws carrier and the plurality of jaws 108 back to initial position of the plurality of jaws carrier and the plurality of jaws 108. Further, the user removes the muzzle end adapter 102 from the bore 112 of the small caliber gun.

The foregoing descriptions of specific embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

What is claimed:

1. A muzzle end adapter for performing bore sighting of a small caliber gun, the muzzle end adapter comprising:

a plurality of hand levers, wherein the plurality of hand levers are positioned at a first end of the muzzle end adapter, wherein the plurality of hand levers comprises a first hand lever and a second hand lever, wherein the first hand lever is rotated in a first direction by a user;

a main operating shaft connected rigidly with the first hand lever, wherein the main operating shaft extends along a longitudinal axis of the muzzle end adapter, wherein the main operating shaft rotates in the first direction upon rotation of the first hand lever by the user;

a cylindrical member connected at one end of the main operating shaft, wherein the cylindrical member extends along the longitudinal axis of the muzzle end adapter, wherein the cylindrical member slides axially upon rotation of the main operating shaft;

a plurality of centering devices, wherein the plurality of centering devices comprises a plurality of jaws, wherein the plurality of jaws comprises a plurality of equiangular spaced jaws centered around a pivot pin, wherein the plurality of jaws extends radially to engage with inner periphery of the small caliber gun upon axial sliding of the cylindrical member; and a disk, wherein the disk comprises a tapered hole connected with the muzzle end adapter, wherein the tapered hole enables attachment of a camera to perform bore sighting of the small caliber gun.

2. The muzzle end adapter as recited in claim 1, wherein the muzzle end adapter is inserted inside a bore of the small caliber gun, wherein the muzzle end adapter is inserted manually by the user.

3. The muzzle end adapter as recited in claim 1, wherein the first hand lever is rigidly connected with the main operating shaft, wherein the second hand lever is rigidly connected with the muzzle end adapter.

4. The muzzle end adapter as recited in claim 1, wherein the plurality of centering devices comprises a plurality of jaws carrier, wherein the plurality of jaws carrier comprises a first jaws carrier and a second jaws carrier, wherein the first jaws carrier and the second jaws carrier are separated by a cylindrical spacer.

5. The muzzle end adapter as recited in claim 1, wherein the plurality of jaws comprises a first plurality of jaws and a second plurality of jaws, wherein the first plurality of jaws are situated on a first jaws carrier, wherein the second plurality of jaws are situated on a second jaws carrier, wherein the plurality of jaws comprises one or more outer edges, wherein the one or more outer edges are concentric to a longitudinal axis of the main operating shaft, wherein each of the one or more outer edges are of equal radius.

6. The muzzle end adapter as recited in claim 1, wherein the muzzle end adapter comprises a plurality of slots on outer periphery of the muzzle end adapter, wherein the plurality of slots provide an inclined surface, wherein the inclined surface receives the plurality of jaws upon rotation of the first hand lever by the user.

7. The muzzle end adapter as recited in claim 1, wherein the camera is attached in the tapered hole using an orienting pin.

8. The muzzle end adapter as recited in claim 1, wherein the muzzle end adapter comprises a second threading onto the first end of the muzzle end adapter, wherein the main operating shaft comprises an equivalent first threading to be inserted into the second threading of the muzzle end adapter.

9. The muzzle end adapter as recited in claim 1, wherein the first hand lever is rotated in a second direction by the user for removing the muzzle end adapter from the small caliber gun.

10. The muzzle end adapter as recited in claim 1, wherein the muzzle end adapter comprises a return spring, wherein the return spring is compressed upon rotation of the first hand lever in the first direction by the user, wherein the return spring is expanded upon rotation of the first hand lever in the second direction by the user.

11. A muzzle end adapter for performing bore sighting of a small caliber gun, the muzzle end adapter comprising:

a plurality of hand levers, wherein the plurality of hand levers are positioned at a first end of the muzzle end adapter, wherein the plurality of hand levers comprises a first hand lever and a second hand lever, wherein the first hand lever is rotated in a first direction by a user;

a main operating shaft connected rigidly with the first hand lever, wherein the main operating shaft extends along a longitudinal axis of the muzzle end adapter, wherein the main operating shaft rotates in the first direction upon rotation of the first hand lever by the user;

a cylindrical member connected at one end of the main operating shaft, wherein the cylindrical member extends along the longitudinal axis of the muzzle end adapter, wherein the cylindrical member slides axially upon rotation of the main operating shaft;

a plurality of centering devices, wherein the plurality of centering devices comprises:

a plurality of jaws, wherein the plurality of jaws comprises a plurality of equiangular spaced jaws centered around a pivot pin, wherein the plurality of jaws extends radially to engage with inner periphery of the small caliber gun upon axial sliding of the cylindrical member, wherein the plurality of jaws comprises a first plurality of jaws and a second plurality of jaws;

a plurality of jaws carrier, wherein the plurality of jaws carrier comprises a first jaws carrier and a second jaws carrier, wherein the first plurality of jaws are situated on a first jaws carrier and wherein the second plurality of jaws are situated on a second jaws carrier; and a disk, wherein the disk comprises a tapered hole connected with the muzzle end adapter, wherein the tapered hole enables attachment of a camera to perform bore sighting of the small caliber gun.

12. The muzzle end adapter as recited in claim 11, wherein the muzzle end adapter is inserted inside a bore of the small caliber gun, wherein the muzzle end adapter is inserted manually by the user.

13. The muzzle end adapter as recited in claim 11, wherein the first hand lever is rigidly connected with the main operating shaft, wherein the second hand lever is rigidly connected with the muzzle end adapter.

14. The muzzle end adapter as recited in claim 11, wherein the first jaws carrier and the second jaws carrier are separated by a cylindrical spacer.

15. The muzzle end adapter as recited in claim 11, wherein the plurality of jaws comprises one or more outer edges, wherein the one or more outer edges are concentric to a longitudinal axis of the main operating shaft, wherein each of the one or more outer edges are of equal radius.

16. The muzzle end adapter as recited in claim 11, wherein the muzzle end adapter comprises a plurality of slots on outer periphery of the muzzle end adapter, wherein the plurality of slots provide an inclined surface, wherein the inclined surface receives the plurality of jaws upon rotation of the first hand lever by the user.

17. The muzzle end adapter as recited in claim 11, wherein the camera is attached in the tapered hole using an orienting pin.

18. The muzzle end adapter as recited in claim 11, wherein the muzzle end adapter comprises a second threading onto the first end of the muzzle end adapter, wherein the main operating shaft comprises an equivalent first threading to be inserted into the second threading of the muzzle end adapter.

19. The muzzle end adapter as recited in claim 11, wherein the first hand lever is rotated in a second direction by the user for removing the muzzle end adapter from the small caliber gun.

20. The muzzle end adapter as recited in claim 11, wherein the muzzle end adapter comprises a return spring, wherein the return spring is compressed upon rotation of the first hand lever in the first direction by the user, wherein the return spring is expanded upon rotation of the first hand lever in the second direction by the user.

* * * * *